US006259877B1

(12) United States Patent
Taniyama et al.

(10) Patent No.: US 6,259,877 B1
(45) Date of Patent: Jul. 10, 2001

(54) TONER CARTRIDGE AND TONER SUPPLY DEVICE

(75) Inventors: Yoshiharu Taniyama, Kawasaki; Shinichi Itoh, Yokohama, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,399

(22) Filed: Feb. 18, 2000

(51) Int. Cl.[7] ..... G03G 15/08

(52) U.S. Cl. ..... 399/262; 222/DIG. 1; 399/120; 399/258

(58) Field of Search ..... 399/262, 258, 399/119, 120; 222/DIG. 1, 167, 325; 141/363, 383

(56) References Cited

U.S. PATENT DOCUMENTS 5,774,773 * 6/1998 Otsuka et al. ..... 399/262
5,867,757 * 2/1999 Okazaki et al. ..... 399/262
5,966,574 * 10/1999 Ui et al. ..... 399/258

FOREIGN PATENT DOCUMENTS 9-211947 * 8/1997 (JP) .
10-20642 1/1998 (JP) .

* cited by examiner

*Primary Examiner*—Sophia S. Chen
(74) *Attorney, Agent, or Firm*—Foley & Lardner

(57) ABSTRACT

A toner supply device includes: a toner cartridge having a cylindrical container with a spiral protruding portion therein, and a cap having a toner discharging hole; and a drive unit for supplying a toner from the toner discharging hole while gripping and rotating the cap of the toner cartridge. A positioning portion is formed on the outer peripheral surface of the base end side of the cylindrical container, and a recessed portion engaging the positioning portion is formed in an inlet holder. The drive unit includes: a holder and a holder cover, which are disassembled vertically; a cup-shaped holder guide, rotatably provided in the holder and holder cover, for gripping the cap at a position, at which the holder guide is communicated with the toner discharging hole; a motor for applying torque to the holder guide; and a drive gear for transmitting torque of the motor to the holder guide. When the toner cartridge is attached on or detached from the drive unit, the toner discharging hole is forced to be open and closed. The toner cartridge is formed with a destination unit for allowing the use of only the same destination in the relationship to a product.

27 Claims, 14 Drawing Sheets

TONER CARTRIDGE AND TONER SUPPLY DEVICE

BACKGROUND OF THE INVENTION

The present invention relates generally to a toner cartridge and a toner supply device for use in an image forming system, such as a copying machine, a facsimile or a printer. More specifically, the invention relates to a toner supply device for supplying a toner while rotating an exchangeable cylindrical toner cartridge and for breaking local accumulation of the toner in the toner cartridge by rotating the toner cartridge in forward and reverse directions by a predetermined angle during exchange of the cartridge or in a desired situation.

In a typical image forming system, the surface of an electrified photosensitive material drum is electrified, and an image information to be copied is exposed to the surface of the drum to form a latent image. Then, a toner is absorbed into the photosensitive material to form a visible image. Us visible image is transferred to the surface of a paper, and the toner is fixed on the surface of the paper by heat and pressure. Then, cleaning and de-electrification are carried out to cause a predetermined image information to be a printed information on the surface of the paper. In a developing process for forming the visible image, the toner, together with a carrier of a magnetic material, is used as a developer.

The carrier serving as a main component included in the developer is used for carrying the toner and producing frictional electrification. Since this carrier is used for electrifying the photosensitive material drum and the surface of the paper to cause the toner to be absorbed thereon, the carrier does not adhere to the surface of the paper and is not consumed, so that the amount of the carrier does not decrease. On the other hand, the toner is gradually consumed to be decreased ken a printed matter is prepared after processes, such as transfer, fixing and cleaning. Therefore, the toner must be supplied as required with the use of the image forming system.

The way for supplying the toner is broadly divided into two methods. One of the methods is a med for providing a toner cartridge dedicated to the copying machine and for supplying a predetermined amount of toner, which is filled in a container, from a supply port of the cartridge when the residual quantity of the toner in the copying machine is short. According to this method, when the toner is supplied to the cartridge from a container, it is difficult for a usual user to skillfully fill the toner in the small-diameter supply port of the cartridge, if not for experts, so that there is the possibility that the toner spills to dirty user's cloths and/or hands. If the spilled toner is raked up to be put in the cartridge, there is also the possibility that impurities are mixed therein.

The other toner supply method is a method using an exchangeable cartridge. This method is an excellent supply method easy to be used, since the exchangeable cartridge is capable of supplying a toner, which is mixed at the best to cause the image forming system to display the best performance to prepare a copied matter, to the developing part of the image forming system without mixing inpurities, and of preventing the user for supplying the toner from spilling the toner or the user's cloths and/or hands from being dirtied.

In order to supply a toner using a conventional toner supply device, an empty cartridge formed so as to have a predetermined shape and standard is detached from a cartridge attaching part of a copying machine, and an exchanged cartridge which has the same shape and standard as those of the empty cartridge and which is filled with a toner, is attached on the cartridge attaching part after being sufficiently shaken. Although there are various shapes and capacities of toner cartridges, there is a cylindrical toner cartridge as one of them. The cylindrical toner cartridge has the merit of being capable of utilizing the inner peripheral wall to efficiently supply a toner to a discharging hole. If the cylindrical cartridge is horizontally arranged, a spiral groove is formed in the inner wall surface of the cylindrical cartridge, or the cylindrical cartridge is rotated about the central axis thereof, so that the toner is guided toward the discharging hole.

However, according to such a conventional toner supply device, it is indicated that the user shall shake the cartridge well before exchange of the cartridge in order to prevent the toner from being locally biased in the cartridge. If the user fails to carry out such a shaking operation, there are some cases where the toner is biased locally in the cartridge. Although the cartridge is exchanged, there is a problem in that the supply of the toner is slow or a desired quantity of supplied toner can not be obtained after exchange of the cartridge.

In addition, according to the above described toner supply device of a type wherein the cylindrical cartridge is rotated, if the power supply of the copying machine is turned off when the cartridge is rotated, the toner discharging hole can not be stopped while facing upwards. Therefore, it is required to provide a mechanism for always detecting the position of the discharging hole when the power supply of the copying machine is turned off regardless of the stop of the copying machine for exchange of the toner cartridge, and for adjusting the stopped position so that the detected discharging hole always faces upwards. Such detecting means or position adjusting mechanism increase the producing costs of the copying machine, so that the user has useless economical loads.

SUMMARY OF THE INVENTION

It is therefore an object of the present invention to eliminate the aforementioned problems in the above described conventional system and to prevent a toner from spilling from a toner cartridge during exchange of the toner cartridge, to introduce an idea of destination into a product itself and the toner cartridge to automatically ensure the right use of the cartridge to maintain the performance of the product.

According to one aspect of the present invention, there is provided a toner cartridge for use in a toner supply device for supplying a toner to an image forming system for forming an optional image including characters and pictures with the toner, the toner cartridge comprising: a toner container having a cylindrical shape having an opening at a tip end thereof, the toner container being filled with a toner therein, the toner container having a spiral protruding portion formed in an inner peripheral surface thereof, and the toner container causing the toner, which is housed therein, toward the opening in an axial direction thereof when being rotated about an axis thereof; a substantially cup-shaped cap engaging the opening and having a toner discharging hole for discharging the toner carried in the toner container, the cap being fixed to the toner container at a predetermined positional relationship when the cap is mounted on the toner container, so that the discharging hole always faces in a predetermined direction when the toner container is turned in a certain rotational direction with respect to the axis thereof; and a cylindrical cover engaging the cap so as to reciprocate in axial directions with respect to the cap between a first position on a tip end side and a second position on a base end side, the cylindrical cover closing the discharging hole to prevent the toner from being discharged at the first position, and opening the discharging hole to allow the toner to be discharged at the second position.

According to another aspect of the present invention, there is provided a toner supply device for supplying a toner to an image forming system for forming an optional image including characters and pictures with the toner, the toner supply device comprising a toner cartridge and a drive unit for rotating the toner cartridge, the toner cartridge comprising: a toner container having a cylindrical shape having an opening at a tip end thereof, the toner container being filled with a toner therein, the toner container having a spiral protruding portion formed in an inner peripheral surface thereof, and the toner container causing the toner, which is housed therein, toward the opening in an axial direction thereof when being rotated about an axis thereof; a substantially cup-shaped cap engaging the opening and having a toner discharging hole for discharging the toner carried in the toner container, the cap being fixed to the toner container at a predetermined positional relationship when the cap is mounted on the toner container, so that the discharging hole always faces in a predetermined direction when the toner container is turned in a certain rotational direction with respect to the axis thereof; and a cylindrical cover engaging the cap so as to reciprocate in axial directions with respect to the cap between a first position on a tip end side and a second position on a base end side, the cylindrical cover closing the discharging hole to prevent the toner from being discharged at the first position, and opening the discharging hole to allow the toner to be discharged at the second position, the drive unit comprising a holder guide for receiving the toner cartridge, and a drive body for rotating the toner cartridge about the axis thereof in the inserted state, and the holder guide having cover forced closing means for contacting the cover to move the cover in the axial direction thereof toward the base end to open the discharging hole when the toner cartridge is inserted, and for contacting the cover to move the cover in the axial direction thereof toward the tip end to close the discharging hole when the toner cartridge is extracted.

DESCRIPTION OF THE PREFERRED EMBODIMENTS

Referring now to the accompanying drawings, the preferred embodiments of a toner supply device for use in an image forming system, according to the present invention, will be described in detail below. In the preferred embodiments described below, a copying machine is used as an example of an image forming system, and wile the detailed structure thereof will be described, a toner supply device for use in the copying machine will be described as an example.

Figure 1:
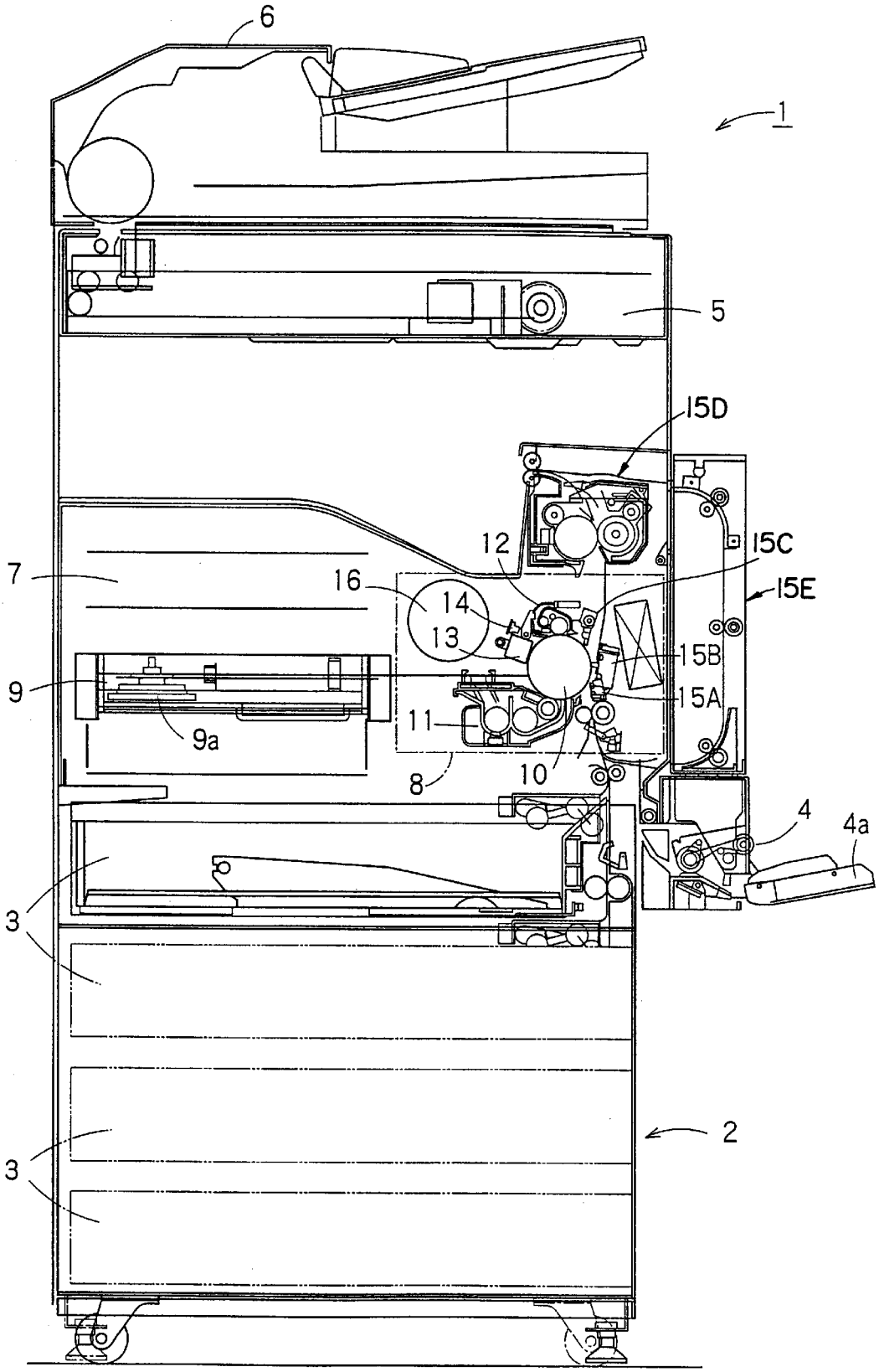
FIG. 1 is a sectional view showing the whole construction of a copying machine as an image forming system, to which a toner supply device according to the present invention is applied.

FIG. 1 is a sectional view showing the whole construction of a copying machine, in which a toner supply device according to the present invention is provided. In FIG. 1, a copying machine 1 has a paper feeding cassette device 2 (a paper feeding unit) for housing therein a large number of papers, in the lower portion of the body thereof. The copying machine 1 also has an LCF paper feeding device 3 for feeding a large number of papers having the same size, and a manual paper feeding device 4, having a manual paper feeding tray 4*a*, capable of manually feeding various kinds of papers having various sizes.

The copying machine 1 crises: an image reading part 5, provided in the upper portion, for reading a manuscript; an automatic manuscript feeding device 6 for feeding the manuscript to the image reading part 5; an image storing part 7 for storing image data read by the image reading part 5; and an optical laser system 9, having a polygon mirror 9*a*, for deriving the stored image data to write an image to be printed, in an image forming part 8.

Figure 2:
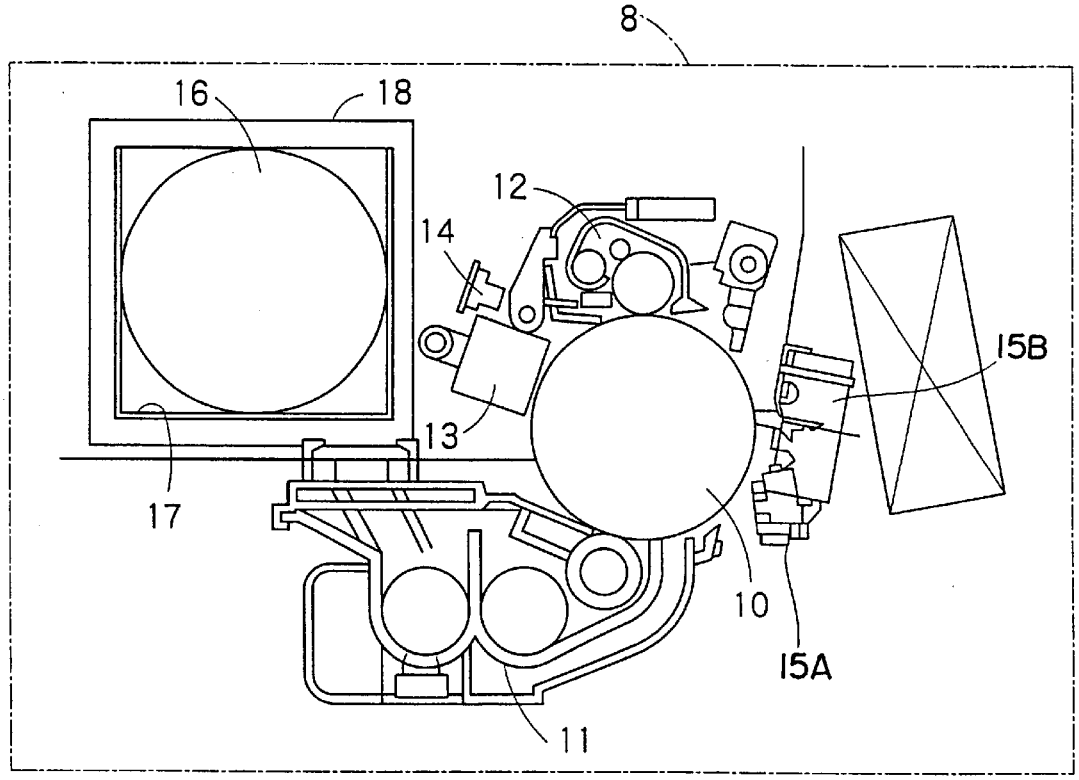
FIG. 2 is a schematic diagram showing a principal part of a toner supply device.

Also as shown in FIG. 2 in addition to FIG. 1, the image forming part 8 comprises a photosensitive material drum 10, a developing device 11, a cleaner (a cleaner unit) 12, an electrification charger 13, a de-electrifying lamp 14, a transfer charger 15A and a peeling charger 15B. On the developing device 11, a toner cartridge (a toner bottle) 16 for supplying a toner, and a driving part 17 (not shown in FIGS. 1 and 2) for rotating the toner cartridge 16 are attached.

Moreover, in the figures, a peeling pawl 15C is provided slightly above the peeling charger 15B, and a fixing device 15D is provided above the peeling pawl 15C. On the right side in these figures, a double face unit 15E is provided.

Figures 3A, 3B:
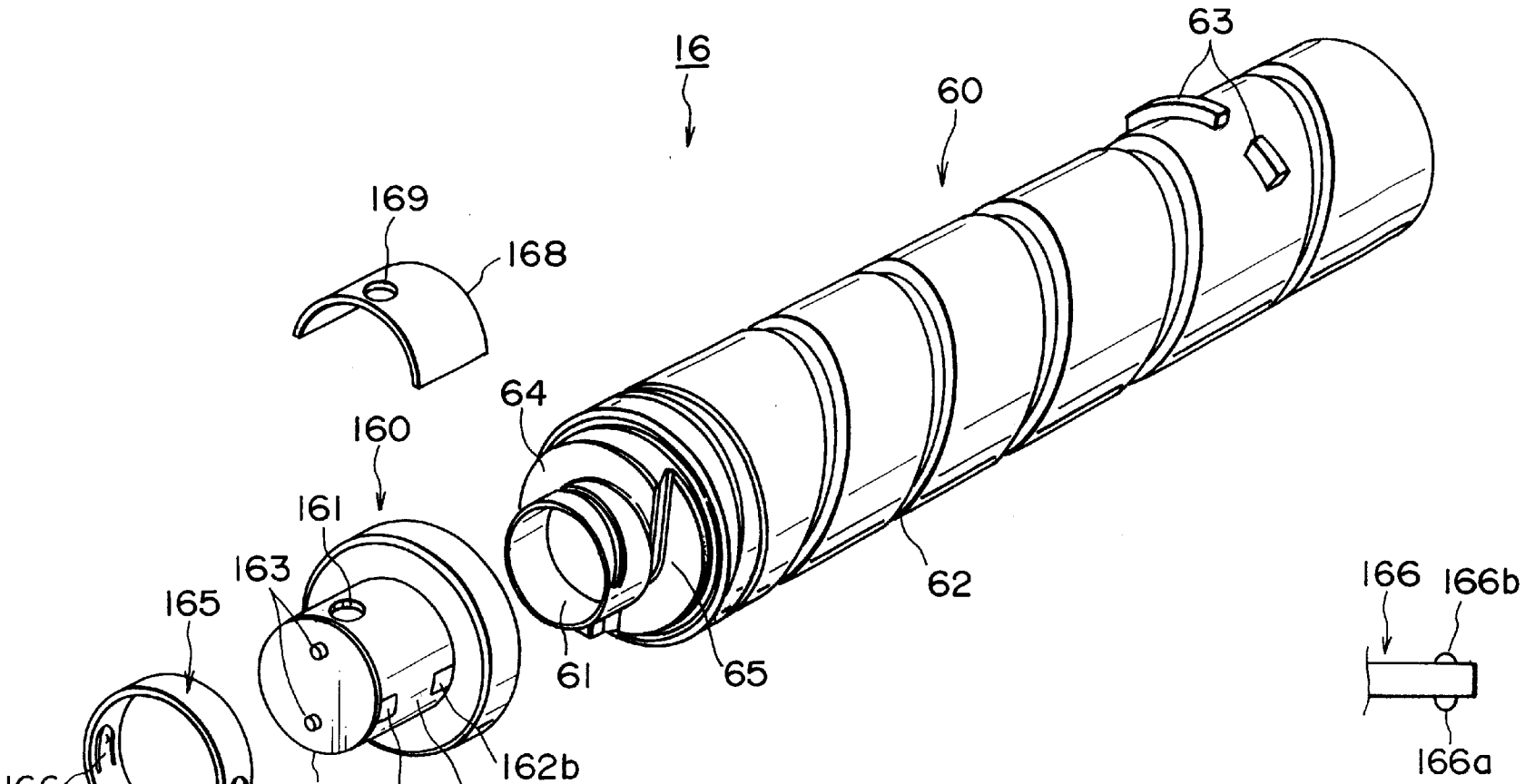
FIG. 3A is an exploded perspective view showing the details of a cylindrical container and cap constituting a toner cartridge.
FIG. 3B is a side view showing a principal part of a tongue piece.

Referring to FIG. 3, the detailed construction of the toner cartridge 16 will be described. In FIG. 3A, the toner cartridge 16 comprises a cylindrical container 60 serving as a body, a cap 160 serving as a toner discharging part, and a cover 165 for shielding the discharging hole.

The cylindrical container 60 has a cylindrical shape with a bottom. At least on the inner peripheral surface of the cylindrical container 60, there is formed a spiral protrusion (not shown) for gradually feeding a toner, which is previously filled, toward an opening portion 61 as the cylindrical container 60 rotates. In the first preferred embodiment shown in FIG. 3, the cylindrical container 60 is formed of a synthetic resin by the blow molding, so that a spiral groove 62 is formed in the outer peripheral surface of the cylindrical container 60 so as to correspond to the spiral protrusion for guide.

At a predetermined position spaced from the bottom of the cylindrical container 60, there are provided positioning portions 63 for positioning the outer periphery of the cylindrical container 60. In the first preferred embodiment shown in FIG. 3, two positioning portions 63 are formed by removing a part of a peripheral flange.

The opening portion 61 of the cartridge 16 is formed at the center of a stepped portion 64 and projects therefrom so as to have a predetermined diameter. A part of the stepped portion 64 is formed with a positioning cut-out stepped portion 65 for integrating the cylindrical container 60 with the cap 160 so as to establish a predetermined relationship between the positions of a discharging hole 161, which will be describe later, and the positioning portions 63 when the cap 160 is mounted on the cylindrical container 60.

The cap 160 has a shape having a stepped portion, which corresponds to the shape of the periphery of the opening portion 61 of the cylindrical container 60, as a whole. The cap 160 has the discharging hole 161 at an optional position on the peripheral wall thereof. The cap 160 is provided for supplying one dose of the toner when the cap 160 is rotated by a half rotation from the initial position to face downwards during the rotation of the toner cartridge 16 after the cap 160 is mounted on the cylindrical container 60. At positions shifted from the discharging hole 161 by 90 degrees in the peripheral wall surface, two engaging portions (protrusions) 162*a* and 162*b* for engaging the discharging-hole shielding cover 165, which will be described later, are provided on each of both sides. Although only the engaging portions 162*a* and 162*b* on one side are shown in FIG. 3, other two engaging portions 162*a* and 162*b* are provided at positions shifted from the engaging portions 162*a* and 162*b* on the shown side by 180 degrees. As will be described in detail later, a groove 162*c* is formed between the two engaging portions 162*a* and 162*b*, and the cover 165 is designed to move in the groove 162*c* in axial directions to contact the engaging portions 162*a* and 162*b*.

On the tip flat surface of the cap 160, there are provided protruding portions 163 serving as positioning portions for engaging positioning recessed portions (not shown) formed in the flat surface of the inner wall of a holder guide of a drive unit 20, which will be described later, to inhibit the rotational shift between the holder guide and the toner cartridge 16. In this first preferred embodiment, the protruding portions 163 are formed by two bosses arranged in radial directions corresponding to the position of the discharging hole 161. In addition, the protruding portions 163 serve to rotate the cylindrical container 60 while receiving the torque of a motor 26 (FIG. 4) which will be described later. On the opposite side of the discharging hole 161 in the radial direction in the peripheral wall of the cap 160, a guide groove 164 for guiding the axial movement of the cover 165 is formed so as to extend in axial directions.

The cover 165 for shielding and opening the discharging hole 161 has a ring shape having a predetermined diameter and a predetermined width which is greater than the diameter of the discharging hole 161. The cover 165 facing the engaging portions 162*a* and 162*b* and grooves 162*c* has protrusions for engaging the engaging portions 162*a* and 162*b*, and elastic spring portions (elastic tongue pieces) 166 formed by forming U-shaped cut-outs in the periphery thereof. That is, the U-shaped cut-outs are formed in the cover 165 in circumferential directions thereof to form elastic tongue pieces 166 serving as cantilevers, and inner and outer stoppers 166*a* and 166*b* are formed on the internal and external surfaces of the tongue pieces 166 (see FIG. 3B). The inner stoppers 166*a* move in the grooves 162 of the cap 160 in axial directions to abut on the protrusions 162*a* and 162*b*. Moreover, as described above, a protruding portion 167 protruding from the inner peripheral surface of the cover 165 in axial directions thereof is provided so as to correspond to the guide groove 164 of the cap 160. The protruding portion 167 is positioned by the guide groove of the parallel protruding portion 164 so that the cover 165 is slidable along the peripheral surface of the cap 160.

Although the discharging hole 161 is open and closed by the sliding of the cover 165, there is a slight gap between the outer peripheral surface of the cap 160 and the inner peripheral surface of the cover 165. In order to prevent the toner from leaking from the gap while shielding the discharging hole 161, a seal 168 of an elastic material, such as felt or sponge, is applied on a portion surrounding the discharging hole 161. The seal 168 has a through hole 169 formed so as to face the discharging hole 161. The construction of the toner cartridge has been described above.

Figure 4:
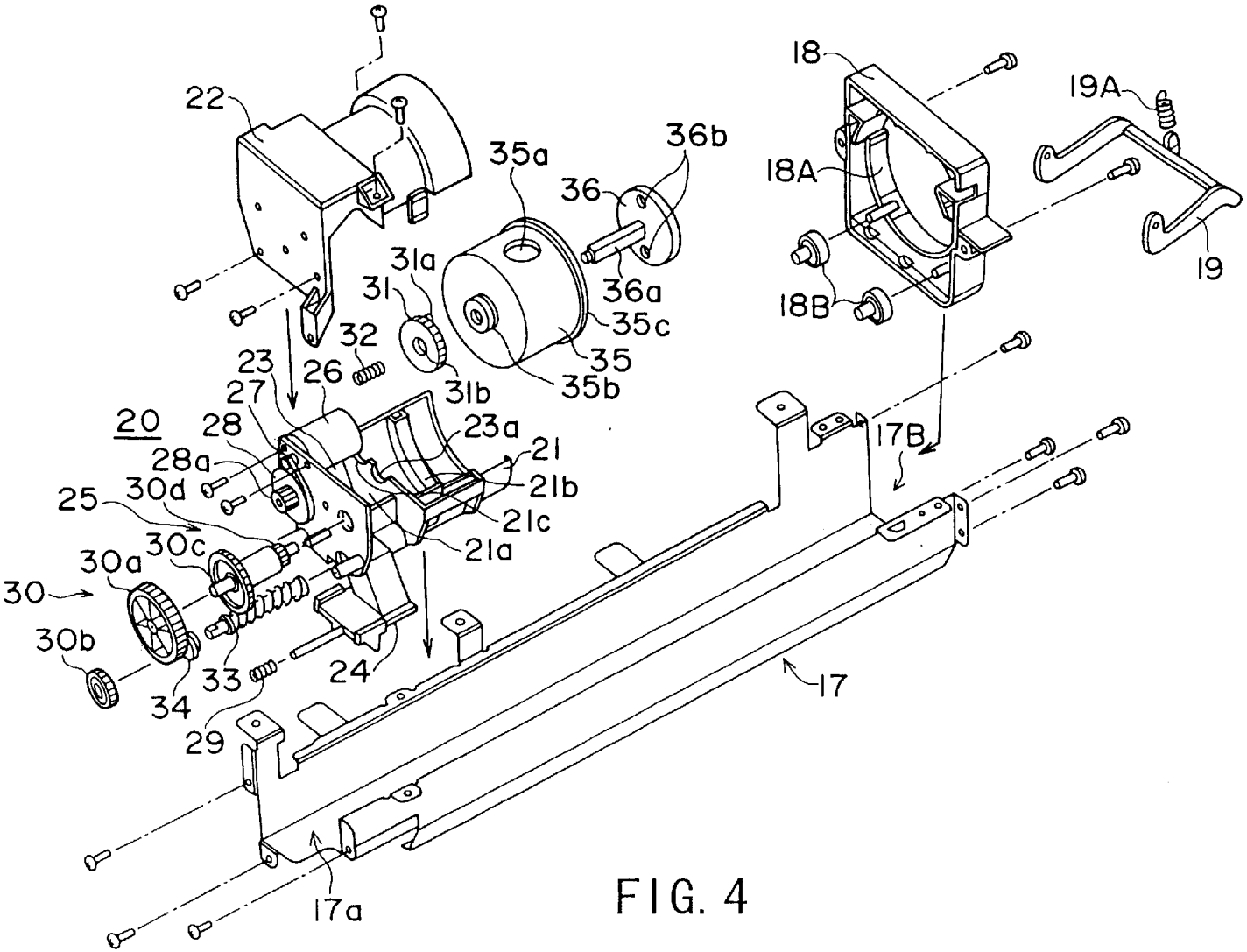
FIG. 4 is an exploded perspective view showing a driving unit of a toner supply device.

Referring to FIG. 4, the construction of the drive unit 20 for rotating the above described toner cartridge 16 will be described below. Briefly, the torque of the motor 26 is transmitted to a disk (driving plate) 36 to rotate the toner cartridge 16 since the protruding portions 163, 163 of the toner cartridge 16 are inserted into recessed grooves (driving holes) 36*b*, 36*b* formed in the disk 36. In addition, a carrier auger 33 is rotated by the motor 26 to move the toner from a chamber 23 to a hopper 24.

The detailed construction of the drive unit 20 will be described below.

In FIG. 4, a cartridge receiving portion (a base body) 17 is secured to the body of the copying machine 1, and is a substantially U-shaped receiving of a metal or synthetic resin. The drive unit 20 is mounted on an end portion 17*a* of the U-shaped receiving portion 17 on the front side in the figure. A rectangular inlet guide 18 is seed to the other end portion 17*b* of the receiving portion 17 by means of a screw or the like. The inlet guide 18 has a guide hole 18A having a diameter capable of receiving the toner cartridge 16, and two rollers 18B along the periphery of the inserting hole 18A for rotatably supporting the toner cartridge 16.

Figure 5:
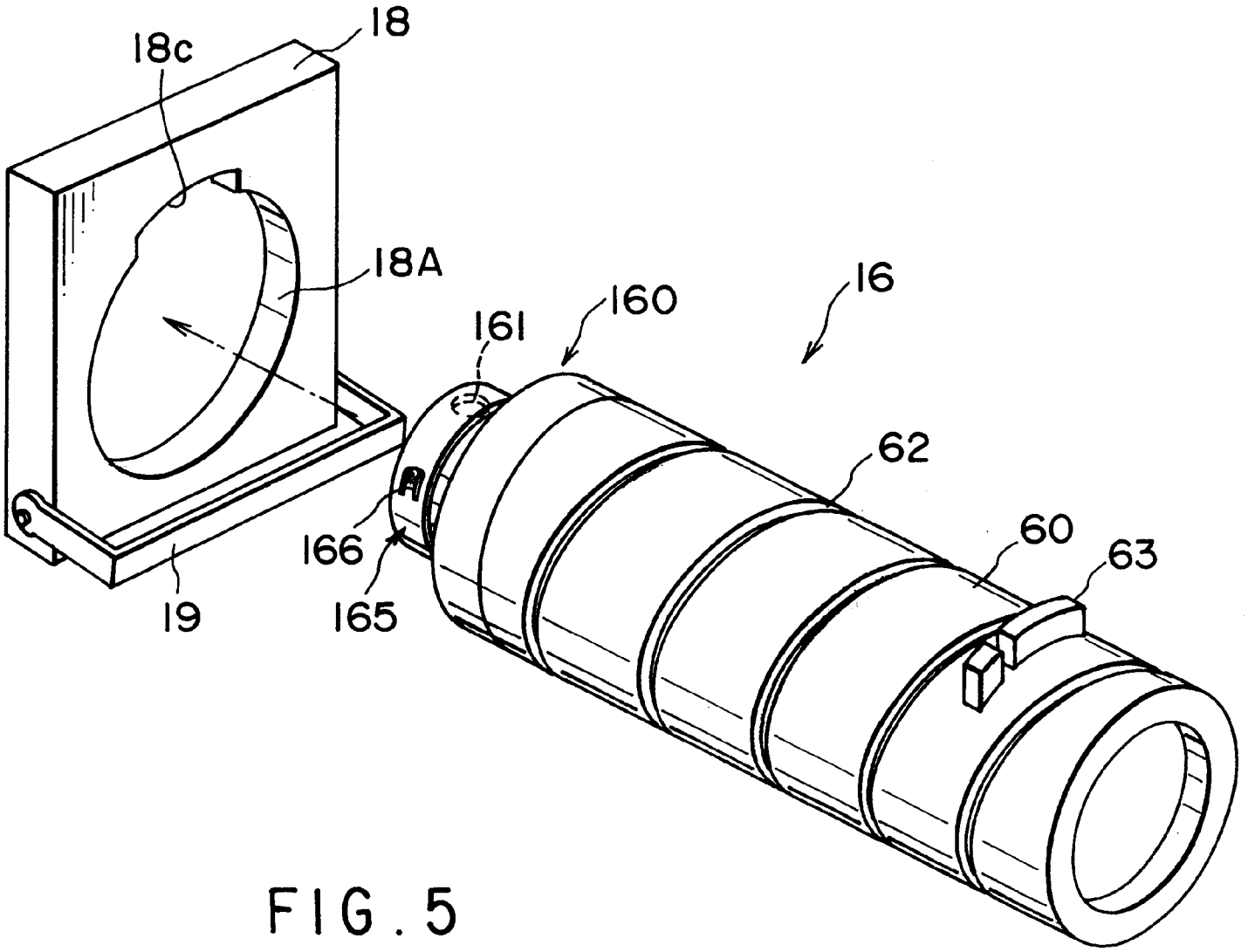
FIG. 5 is a perspective view showing a toner cartridge while being inserted into an inlet holder.

On the inlet guide 18, there is mounted a substantially C-shaped biasing lever 19 for biasing the bottom of the cylindrical container 60 toward the drive unit 20 after the toner cartridge 16 is attached. The biasing lever 19 biases the cylindrical container 60, which is inserted by a spring 19A in a horizontal direction, toward the drive unit 20 from the guide 18. FIG. 5 is a perspective view schematically showing the inlet holder 18, the biasing lever 19 and the toner cartridge 16 when the toner cartridge 16 is inserted into the inlet holder 18. As shown in this figure, on the upper side of the inner peripheral surface of the inserting hole 18A of the inlet holder 18, there is formed a recessed portion 18C engaging the protruding positioning portion 63 of the cylindrical container 60, i.e., allowing the insertion and extraction of the toner cartridge 16.

As shown in FIG. 4, the drive unit 20 comprises: a substantially semicylindrical holder 21; a holder cover 22 integrated with the holder 21 for forming a cylinder which is open toward the inlet guide 18; a chamber 23 defined by the holder 21 and the holder cover 22; a hopper 24 for supplying a toner, which is filled in the chamber 23, to the developing device 11; and a drive mechanism 25 arranged in the vicinity of the chamber 23. The holder 21 and the holder cover 22 have a shape formed by dividing a cylinder. The holder 21 has a partition wall 21*a* defining the chamber 23, and an engaging partition wall 21*b* engaging a flange portion 35*c* of a holder guide 35 which will be described later. The partition wall 21*a* has a cut-out 21*c* which is associated with a facing partition wall (not shown) of the holder cover 22 for forming a hole.

The drive mechanism 25 comprises a motor 26 serving as a driving source, a belt 27, a pulley 28, drive gear sets 30, 31, a spring 32, a carrier auger 33 for promoting the movement of the toner from the chamber 23 to the hopper 24, a bush 34, a holder guide 35 and a disk 36. Furthermore, reference number 29 denotes a spring mounted on a pin of a cover of the hopper 24. The drive gear set 30 comprises: a large diameter first gear 30*a*; a second gear 30*b* which meshes with the first gear 30*a* and which is mounted on the carrier auger 33 via the bush 34; a third gear 30*c* which meshes with a gear 28*a* integrated with the pulley 28 outside of the chamber 23; and a fourth gear 30*d* mounted on one end of a shaft, on the other end of which the third gear 30*c* is mounted. The fourth gear 30*d* is arranged in the chamber 23, and is designed to mesh with the gear set 31 fixed to the holder guide 35.

The holder guide 35 is a cup-shaped member having a diameter which is a size larger than the cylindrical portion at the tip of the cap 160 of the toner cartridge 16 shown in FIG. 3. The holder guide 35 has a supply hole 35*a* which is formed so as to correspond to the discharging hole 161 of the cap 160. The central portion of the bottom of the holder guide 35 protrudes in the form of a boss, in which an elliptic or D-shaped hole 35*b* is formed. The disk 36 has a shaft 36*a* having a D-shaped cross section so as to pass through the D-shaped hole 35*b* of the holder guide 35, and holes or recessed portions 36*b* formed in the disk 36 on a line defining a diameter thereof at positions which are symmetrical with respect to the longitudinal central axis of the flat surface of the shaft 36*a*. Furthermore, reference number 35*c* denotes a flange portion for causing the holder guide 35 to engage the holder 21, and reference number 35*d* shown in FIG. 6 denotes an engaging protrusion engaging the cover 165 of the cap 160 to open the discharging hole 161.

The recessed portion 36*b* has a shape and size so as to engage the protruding portion 163 protruding from the tip end surface of the cap 160 of the toner cartridge 16. When the protruding portion 163 and the shaft 36*a* engage the recessed portion 36*b* and the D-shaped hole 35*b*, respectively, the toner cartridge 16 and the holder guide 35 are integrally rotated while at least the rotational shift therebetween is inhibited. In addition, the gear set 31 has a protrusion 31*a* engaging a hole which is formed by the cut-out 21*c* formed in the partition wall 21*a* of the holder 21, and the cut-out (not shown) of the holder guide 22 facing the cut-out 21*c*, and a D-shaped hole 31*b* having a shape corresponding to the D-shaped hole 35*b* of the holder guide 35. The tip portion of the shaft 36*a* of the disk 36 passes through the D-shaped holes 35*b* and 31*b* to engage the spring 32 while playing therewith, so that the shaft 36*a* rotatably engages a shaft receiving portion 23*a* formed in the inner wall of the chamber 23. The shaft receiving portion 23*a* is shown in the sectional view of FIG. 6 although it is not shown in the exploded perspective view of FIG. 4.

The respective parts with the above described constructions are previously assembled except for the toner cartridge 16. The drive unit 20 is assembled to be mounted on the one end side 17*a* of the cartridge receiving portion 17, and the inlet holder 18 having the biasing lever 19 is mounted on the other end portion 17*b*. The drive mechanism 25 of the drive unit 20 is mounted on the inside and outside of the chamber 23 separated by the partition wall 21*a* of the holder 21, to constitute the gear systems 30 and 31. The holder guide 35 is provided between the partition wall 21*a* of the holder 21 and the engaging partition wall 21*b* engaging the flange portion 35*c* of the holder guide 35 while the disk 36 of the holder guide 35 is mounted. While all of the parts are combined with the holder 21, the holder 21 is covered with the holder cover 22 to be fixed by the shown screw to be assembled, and thereafter, the assembly is fixed to the one end side 17*a* of the cartridge receiving portion 17.

Referring to FIGS. 5 through 7C, the operations for attaching and detaching the toner cartridge 16 on and from the toner supply device with the above described construction will be described. First, in order to attach the toner cartridge 16 on the drive unit 20, after the toner cartridge 16 is horizontally arranged to be sufficiently shaken, the toner cartridge 16 is inserted into the guide hole 18A of the inlet holder 60 from the side of the cap 160 as shown in FIG. 5. At this time, if the toner cartridge is inserted so that the protruding positioning portion 63 of the cylindrical container 60 is coincident with the recessed portion 18C of the inlet holder 18, the discharging hole 161 of the cap 160 is inserted while remaining facing upwards. However, since the discharging hole 161 of the cap 160 is closed by the ring-shaped cover 165 at this time, the cover 165 can also prevent the toner from leaking.

Figure 6:
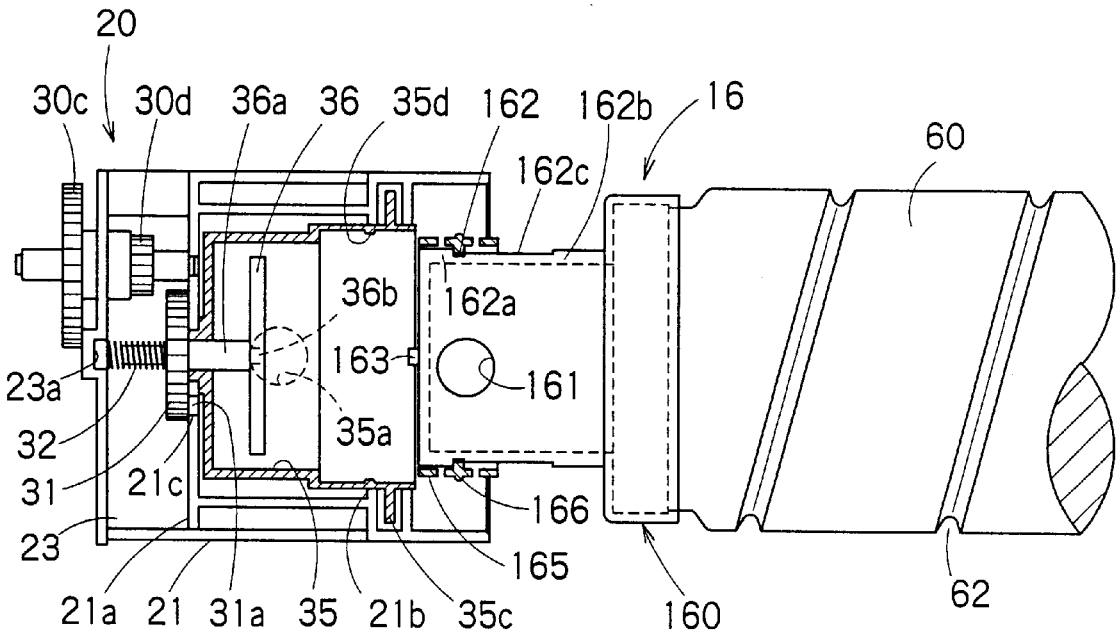
FIG. 6 is a sectional view showing a toner cartridge immediately before being attached.

FIG. 6 is a plan view showing the state that the tip portion of the toner cartridge 16 engages the drive unit 20, which is viewed from the top of FIG. 5 to show the holder 21 and the toner cartridge 16 while the holder cover 22 is removed. This figure shows a cross section of only the holder guide 35 and the cover 165 of the cap 160. If the cartridge 16 is further inserted from the position shown in FIG. 6, the protruding portion 163 serving as the positioning portion engages the recessed portion 36*b* of the disk 36 to cause the tip end surface of the cap 160 to push the disk 36.

Slightly before this, the engaging protrusion 35*d* formed on the inner peripheral surface of the holder guide 35 engages the outer stopper 166*b* of the elastic tongue piece of the cover 165. Thus, the cover 165 slides while the protrusion 167 is guided by the groove 164 shown in FIG. 3, so that the discharging hole 161 is open. Thus, the discharging hole 161 is open in the holder guide 35, and the discharging hole 161 is coincident with the supply hole 35*a* of the holder guide immediately after the discharging hole 161 is open. In this state, the protrusion 31*a* of the gear set 31 engages the hole formed by the cut-out 21*c* of the holder 21 and the cut-out of the holder cover 22 facing the cut-out 21*c*. In FIG. 6, the cover 165 moves to the right with respect to the cap 160, so that the inner stopper 166*a* abuts on the engaging portion 162*b*. If the cartridge 16 is further thrust, the upper stopper 166*b* moves to the left in the figure to pass over the engaging protrusion 35*d* to a position shown in, e.g., FIG. 7A.

Figure 7A:
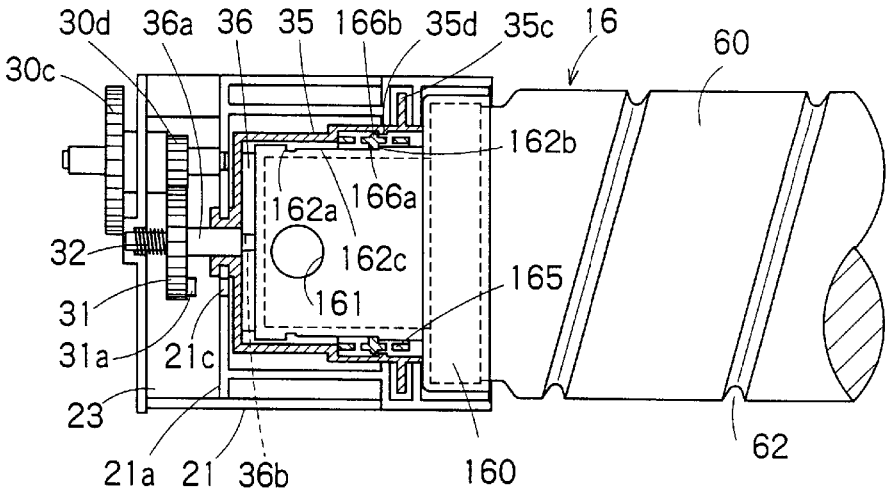
FIGS. 7A through 7C are sectional views showing the operation of detaching a toner cartridge.

Referring to FIG. 6 again, when the toner cartridge 16 is further thrust as described above, while the tip end surface of the cap 160 presses the disk 36 while the protruding portion 163 engages the recessed portion 36*b*, the shaft portion 36*a* contacts the shaft receiving portion 23*a* against the spring force of the spring 32 to be positioned. In this state, the gear set 31 need on the shaft portion 36*a* meshes with the fourth gear 30*d* of the gear set 30. This state is shown in FIG. 7A. By driving the motor 26 in this state, the torque of the motor is transmitted by the drive mechanism 26 comprising the gear sets 30 and 31 to rotate the cap 160 and the cylindrical container 60.

Figure 7B:
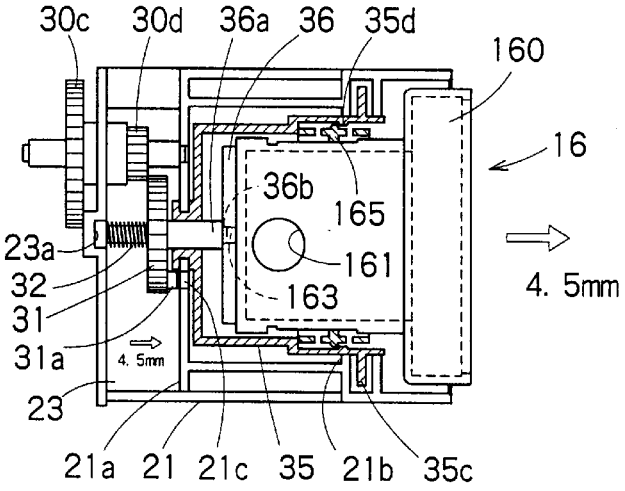
Figure 7C:
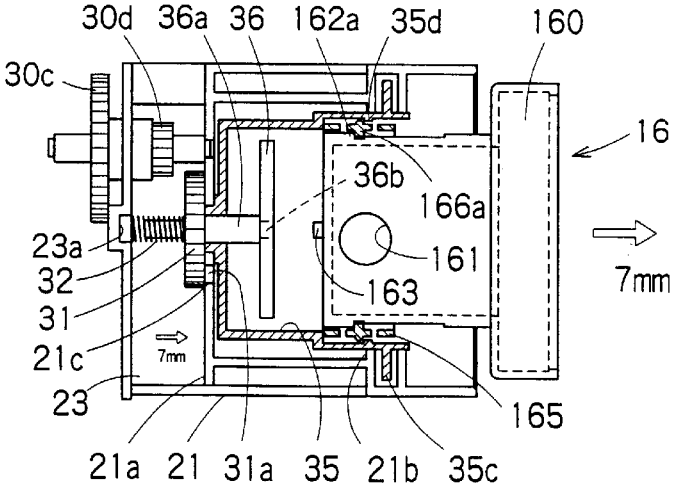

Referring to FIGS. 7A through 7C, the operation of detaching the toner cartridge by the drive unit 20 will be described below. In the conventional toner supply device, it is required to stop the rotation of the toner cartridge at a position, at which the discharging hole and the supply hole face upwards, so as to prevent the toner from leaking from the discharging hole of the cap and the supply hole of the holder guide. However, in the first preferred embodiment of a toner supply device according to the present invention, the rotation of the toner cartridge 16 can be stopped even if the discharging hole 161 is arranged at any rotational positions.

That is, although the toner cartridge 16 can be stopped even if the supply hole 35*a* of the holder guide 35 and the discharging hole 161 of the cap 160 are arranged at any positions, if the toner cartridge 16 is intended to be detached in this state, the toner cartridge 16 can not be detached since the recessed portion 18C of the inlet holder provided at the other end portion of the toner cartridge 16 is not coincident with the protruding positioning portion 63 of the container 60.

When the toner cartridge 16 is detached, the biasing lever 19 mounted on the inlet guide 18 is first open. At this time, the toner cartridge 16, the holder guide 35, the disk 36 and the gear set 31 are moved by the spring 32 by 4.5 mm in the direction shown by the arrow. By this movement by 4.5 mm, the gear 30D is disengaged from the gear set 31, so that the toner cartridge 16 can freely rotate.

Then, by freely rotating the toner cartridge 16 to cause the recessed portion 18C of the inlet guide 18 to be coincident with the protruding positioning portion 63 of the container 60, the toner cartridge 16 can be detached. At this time, since the toner cartridge 16 meshing with the disk 36 is rotated so that the protrusion 31*a* of the gear set 31 is coincident with the position of the engaging hole which is formed by the cut-out 21*c* of the partition wall 21*a* of the holder 21 and the cutout of the holder cover 22 facing the cut-out 21*c*, the toner cartridge 16, the holder guide 35 and the gear set 31 are further moved by the spring 32 by 2.5 mm in the direction shown by the arrow (therefore, the total quantity of movement is 7 mm).

Thus, even if the toner cartridge 16 is detached, the holder guide 35 is fixed at the lower position so that the supply hole 35*a* faces upwards. Therefore, when a new toner cartridge 16 is inserted, the discharging hole 161 is always coincident with the supply hole 35*a* since the holder guide 35 is positioned.

In addition, when the drive mechanism is operated while the toner cartridge 16 is detached, the gear set 31 is disengaged from the gear 30*d*, so that the holder guide 35 does not rotate. Therefore, the supply hole 35*a* is not shifted, and the gears are not damaged.

Thus, when the toner cartridge 16 is attached and detached without providing the holder guide 35 with any detection mechanisms, the holder guide 35 can be always fixed at a predetermined position. Thus, even if the toner cartridge 16 is detached at any positions, when the toner cartridge 16 is attached again, if the toner cartridge 16 is attached while the protruding positioning portion 63 of the toner cartridge 16 is coincident with the recessed portion 18C of the inlet holder 18, the toner cartridge can be driven while the discharging hole 161 is coincident with the supply hole 35*a*.

In this state, the discharging hole 161 of the toner cartridge 16 is gradually being closed by the cover 165 shown by the two-dot chain line in FIG. 7B. If this is further extracted, the discharging hole 161 is completely closed as shown in FIG. 7C, so that the discharging hole 161 can remain being closed when the toner cartridge 161 is extracted. In this state, if the disk 36 is further moved by 2.5 mm by the biasing force of the spring 32, the toner cartridge 16 is moved by "4.5+2.5= 7 mm" toward the inlet holder 18 as shown in FIG. 7C. In this state, since the bottom portion of the toner cartridge 16 is protruded by at least 7 mm from the inlet holder 18, if the user holds and extracts the bottom portion of the cylindrical container 60 of the toner cartridge 16, the used toner cartridge 16 can be extracted.

The closing of the discharging hole 161 of the cap 160 by the cover 165 during extraction of the toner cartridge 16 is described as follows.

Since the outer stopper 160 of the cover 165 contacts the engaging protrusion 35*d* when the cartridge 16 is extracted in FIG. 7A, the cover 165 holds its position, and only the cartridge 16 moves to the right so as to be extracted as can be seen from FIG. 7B. Then, the inner stopper 166*a* contacts the engaging portion 162*a* of the cap 160 as can be seen from FIG. 7C. When the cartridge 16 is further extracted, the outer stopper 166*b* passes over the engaging protrusion 35*d* in the right direction in the figure. Thus, the state shown in FIG. 6 is obtained.

Figure 8:
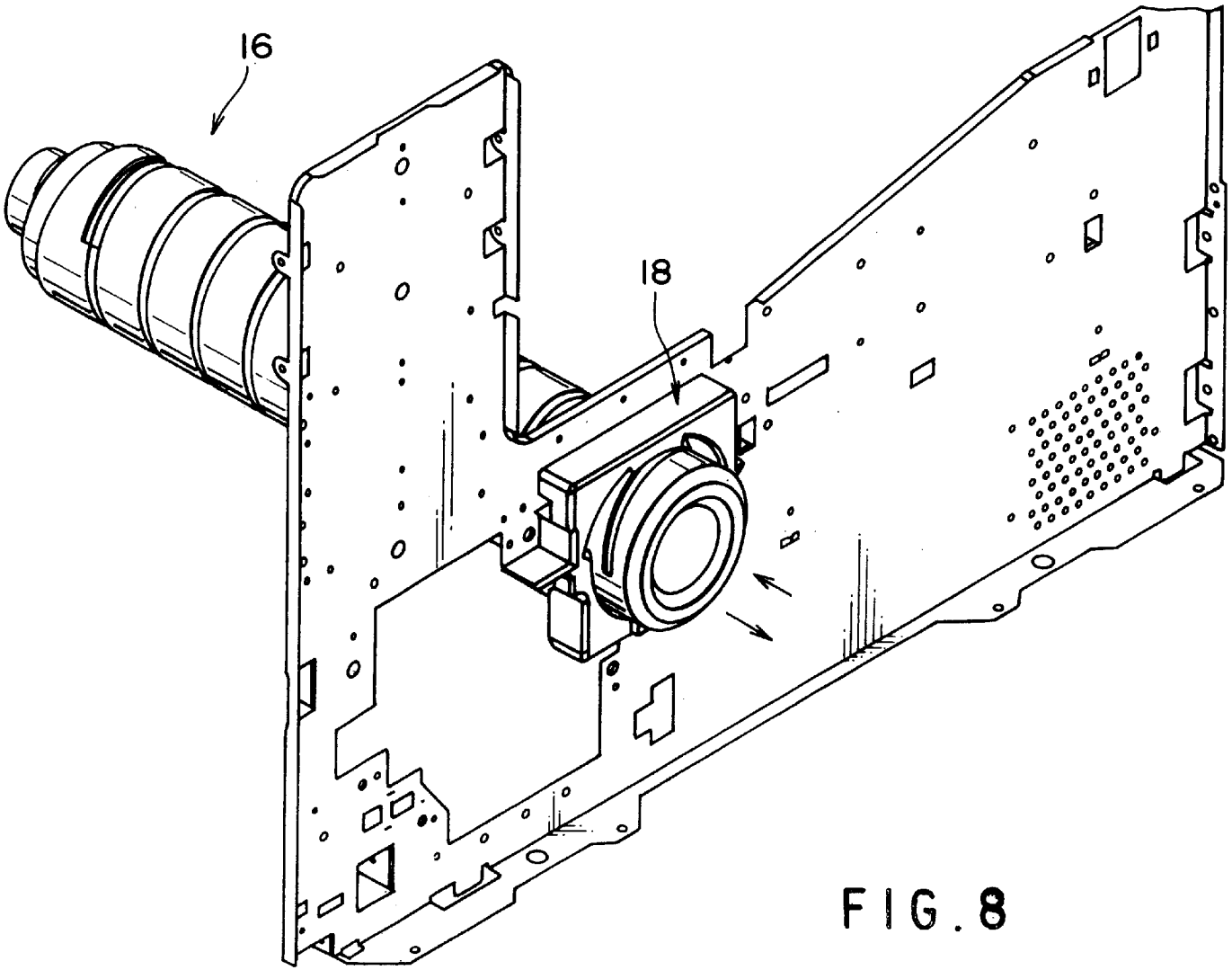
FIGS. 8 through 10 are perspective views showing the attachment or detachment of a toner cartridge.
Figure 9:
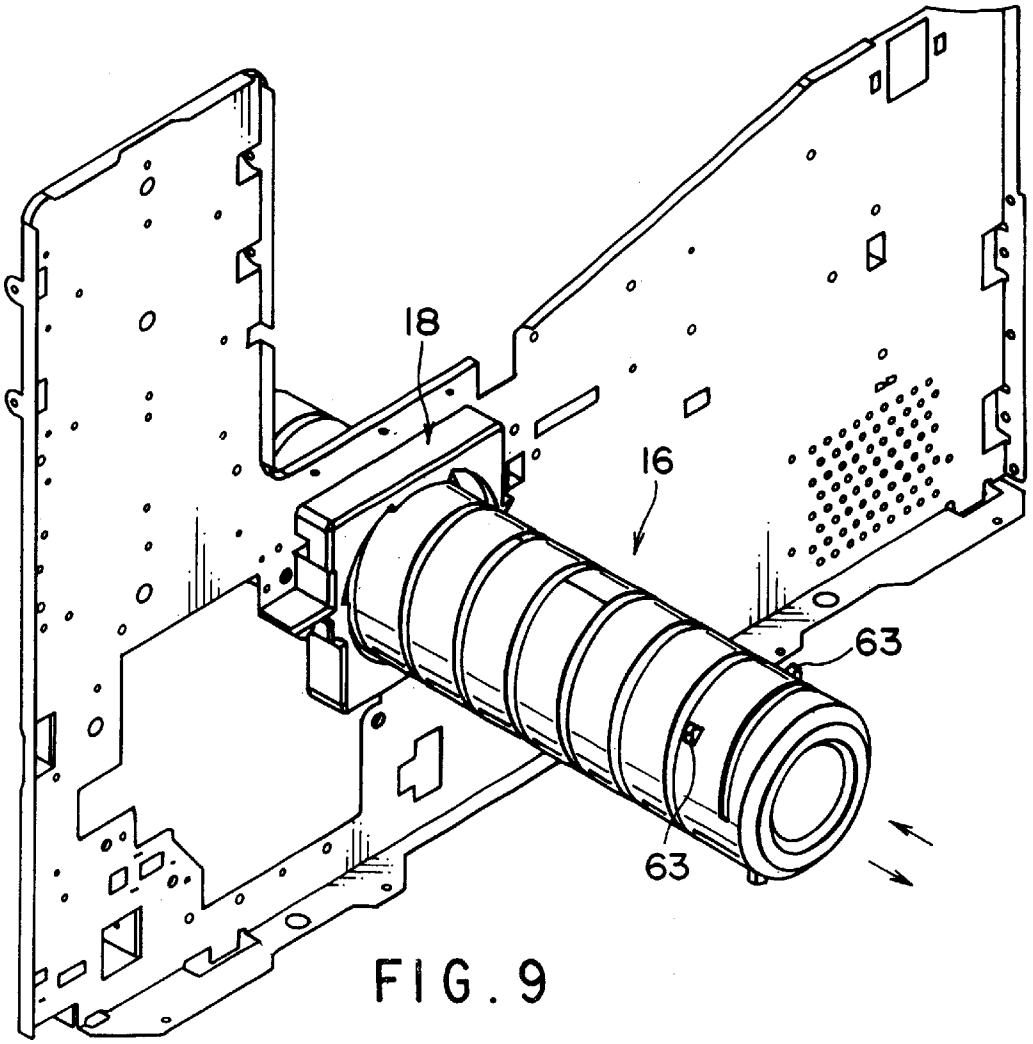
Figure 10:
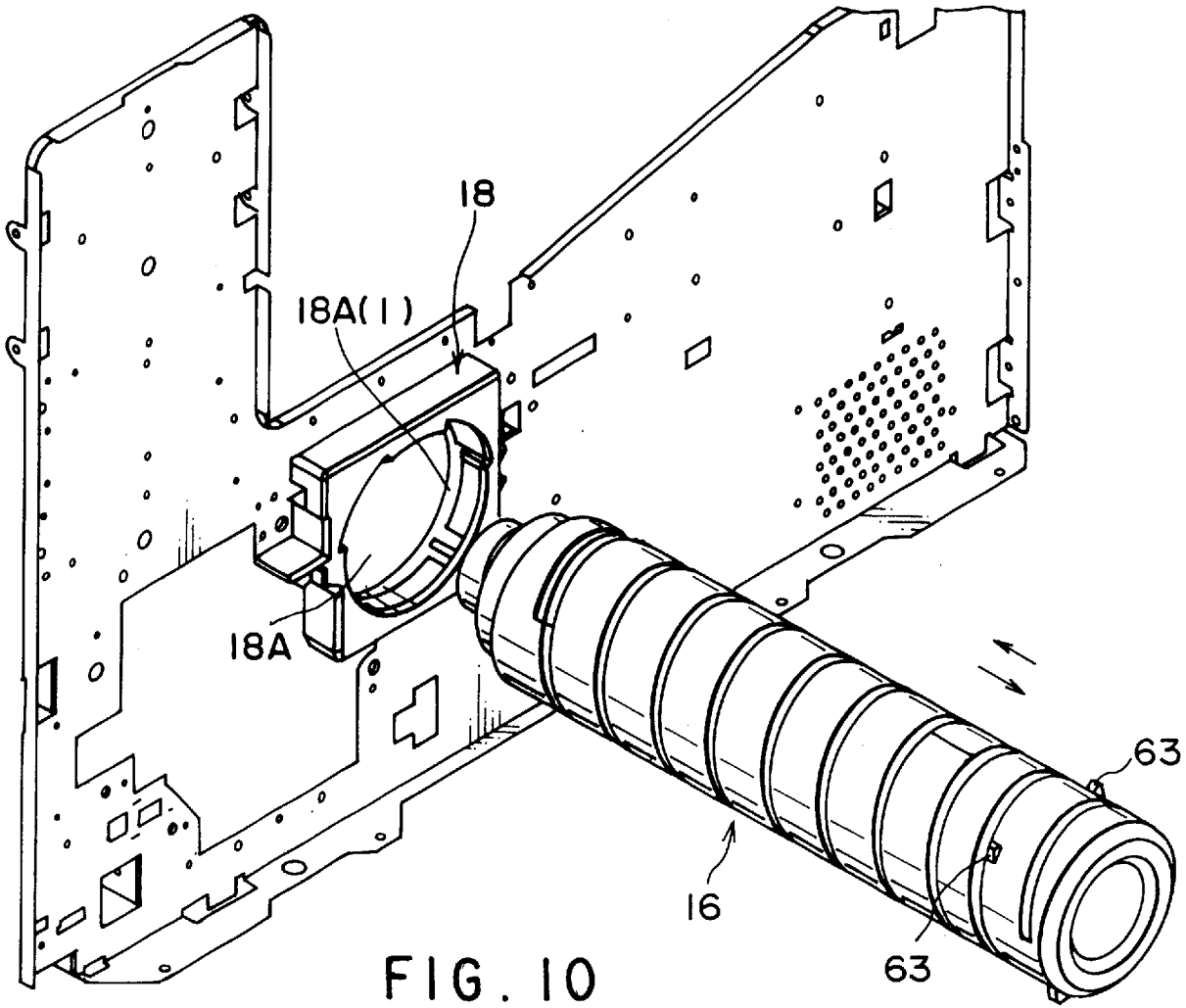

As described above, the toner cartridge 16 is inserted into or detached from the drive unit 20, i.e., the copying machine. An example thereof can be seen from, e.g., FIGS. 8 through 10. That is, FIG. 8 shows the mounting state of the toner cartridge 16, which is extracted as shown in FIG. 9, and the extraction is completed as shown in FIG. 10. The insertion can be understood by viewing FIGS. 10, 9 and 8 in that order.

Figure 11A:
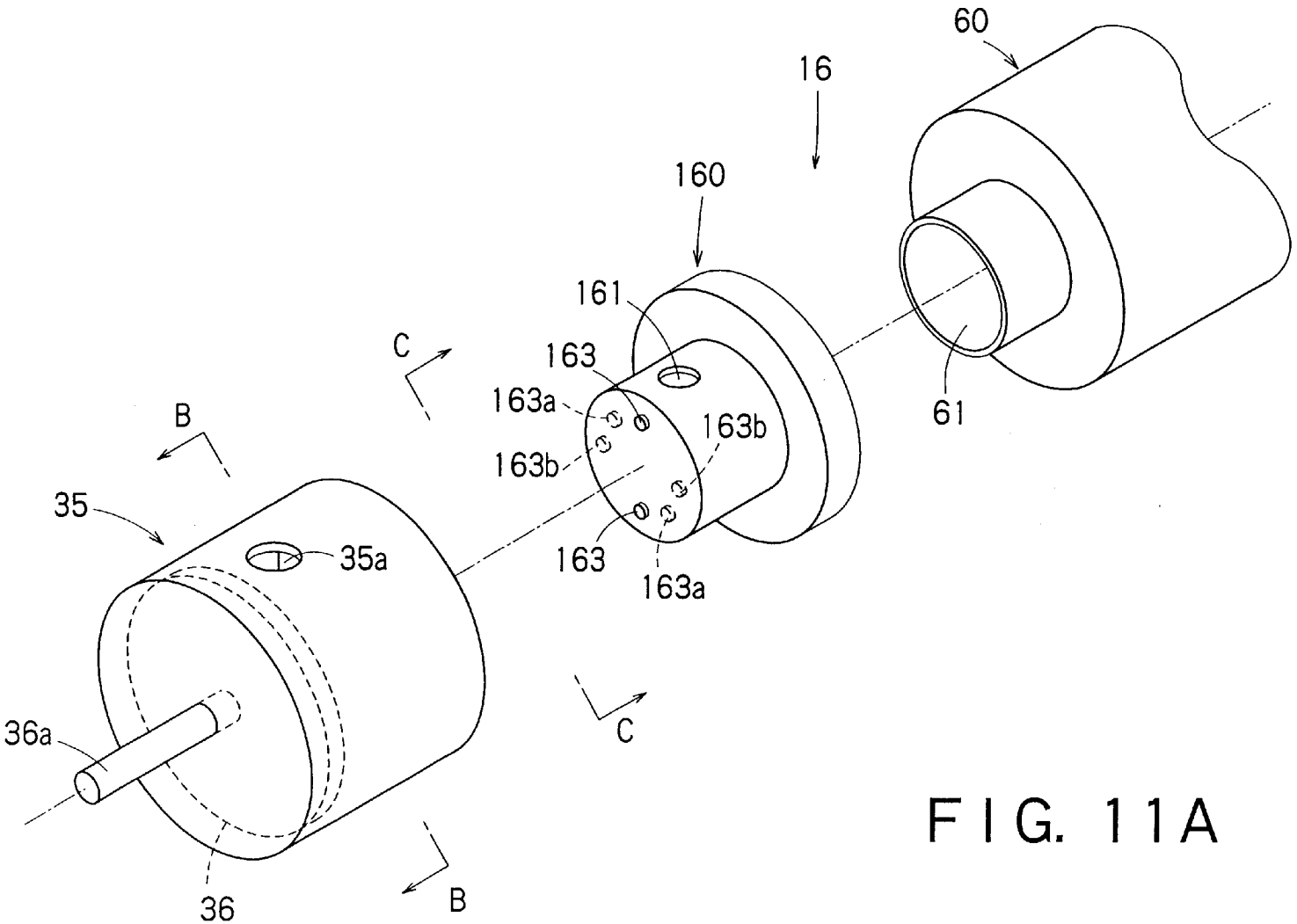
FIG. 11A is a perspective view showing a holder guide, a cap and a toner container.
Figure 11B:
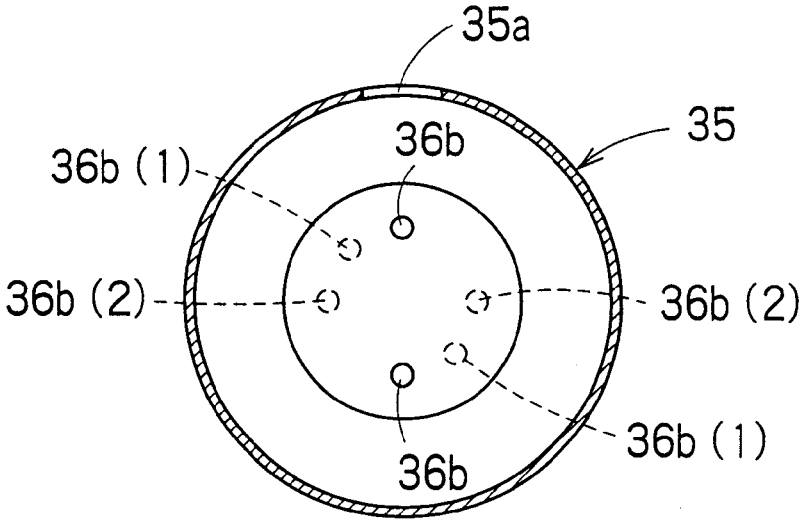
FIGS. 11B and 11C are sectional views showing the relationship between the positions of a protrusion of a cap and a drive hole of a drive plate in accordance with destination.
Figure 11C:
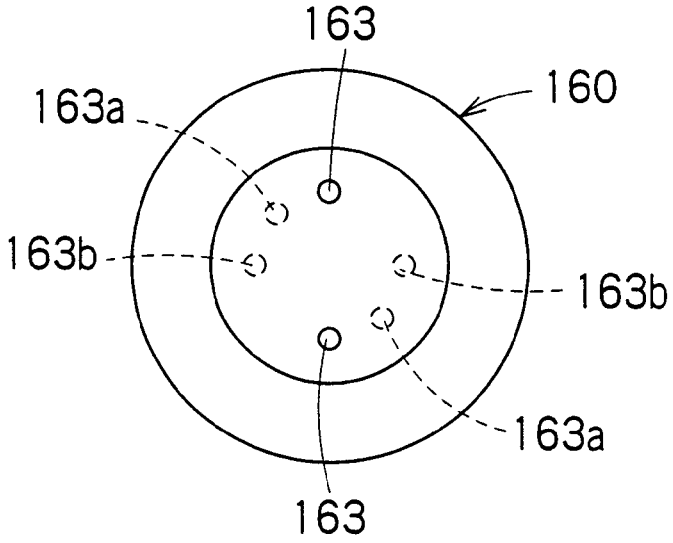

FIGS. 11B and 11C are views taken along lines B—B and C—C of FIG. 11A, respectively. On the basis of these figures, the circumferential direction phase relationship (positional relationship) between the drive holds 36*b*, 36*b* of the drive plate 36 and the protrusions 163, 163 of the cap 160, and the phase relationship (positional relationship) between the supply hole 35*a* of the holder guide 35 and the discharging hole 161 of the cap 160 will be described below.

FIG. 11A schematically shows the holder guide 35, the cap 160 and the cylindrical container 60. As can be seen from FIG. 11B, in the holder guide 35, the drive plate 36 is stopped so that the drive holes 36*b*, 36*b* are arranged vertically.

On the other hand, as shown in FIG. 11A, in the toner cartridge 16 positioned during attachment or detachment, the discharging hole 161 faces upwards, and the protrusions 163, 163 are arranged vertically. Therefore, when the toner cartridge 16 is mounted on the drive unit 20, the protrusions 163, 163 of the cap 160 engage the drive holes 36*b*, 36*b* of the drive plate 36, and the supply hole 35*a* of the holder guide 35 is coincident with the discharging hole 161 of the cap 160.

On the other hand, as shown in FIG. 11A, if protrusions are provided on the cap 160 at the positions of 163*a*, 163*a* in place of the protrusions 163, 163, the protrusions thus provided do not engage the vertically arranged drive holes 36*b*, 36*b* of the drive plate shown in FIG. 11. At this time, the drive holes must be formed in the drive plate 36 at the positions of 36*b*(2), 36*b*(2) as shown in FIG. 11B.

This is the same with respect to the protrusions 163*b*, 163*b* and the drive holes 36*b*(2), 26*b*(2).

That is, the foregoing can be applied to, e.g., destination.

For example, a first set of drive holes 36*b*, 36*b* and protrusions 163, 163 are provided in a product for a first region, and a second set of drive holes 36*b*(1), 36*b*(1) and protrusions 163*a*, 163*a*, and a third set of drive holes 36*b*(2), 36*b*(2) and protrusions 163*b*, 163*b* are provided in products for second and third regions. Thus, for example, if a toner cartridge 16 for the second region is intended to be used for a product for the first region, if the toner cartridge 16 is slightly twisted with respect to the derive unit 20, the protrusions 163*a*, 163*a* can not be inserted into the drive holes 36, 36. However, in this state, although the cartridge 16 can be driven, the supply hole 35*a* is shifted from the discharging hole 161, so that the toner can not be supplied. Finally, the toner cartridge 16 can not be used.

Figure 12A:
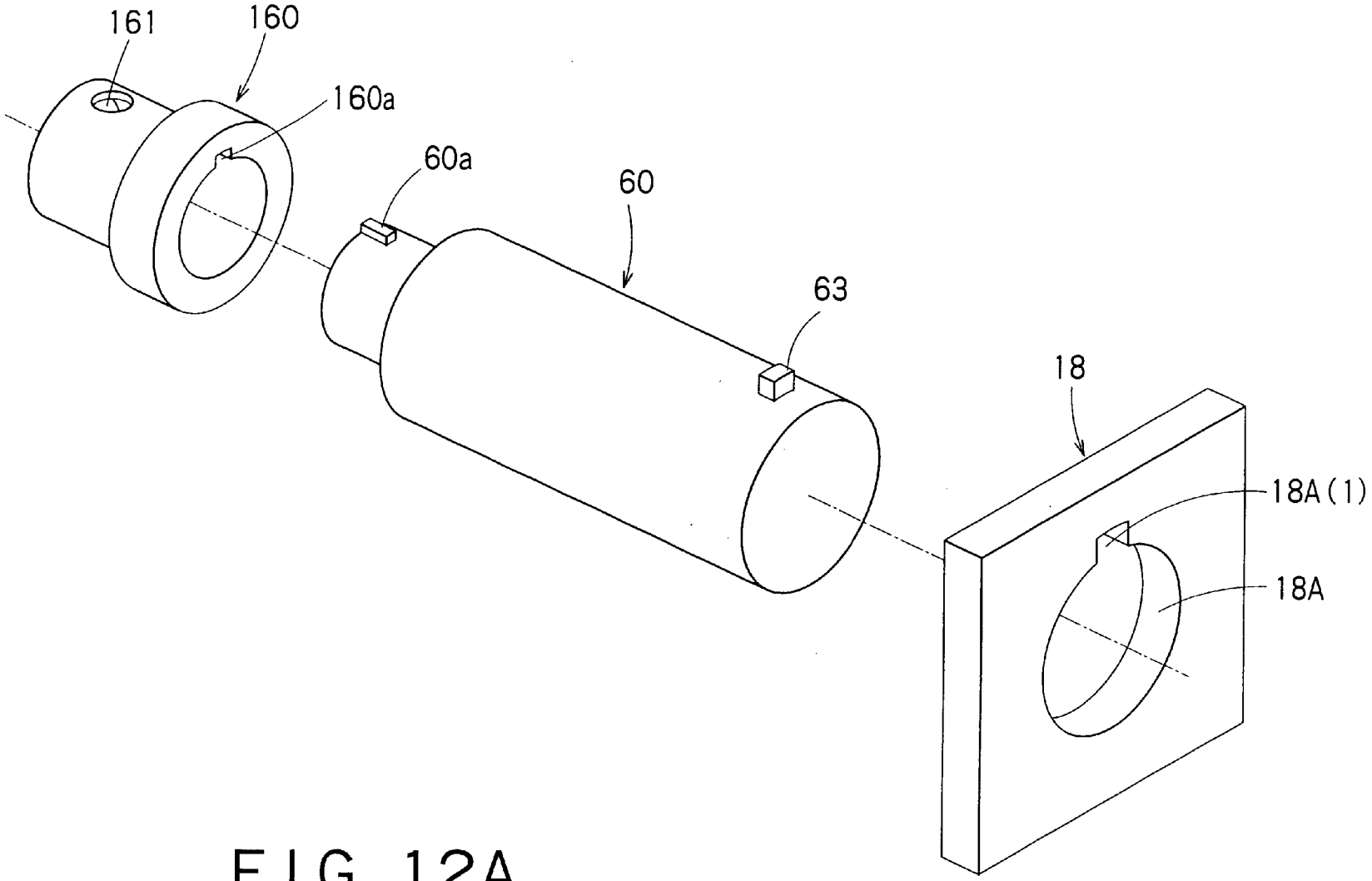
FIGS. 12A and 12B are perspective views showing the relationship between a cap, a toner container and an inlet guide in accordance with destination.

FIG. 12A shows another method using the inlet guide 160 and the cylindrical container 60 as a way of destination.

Figure 12B:
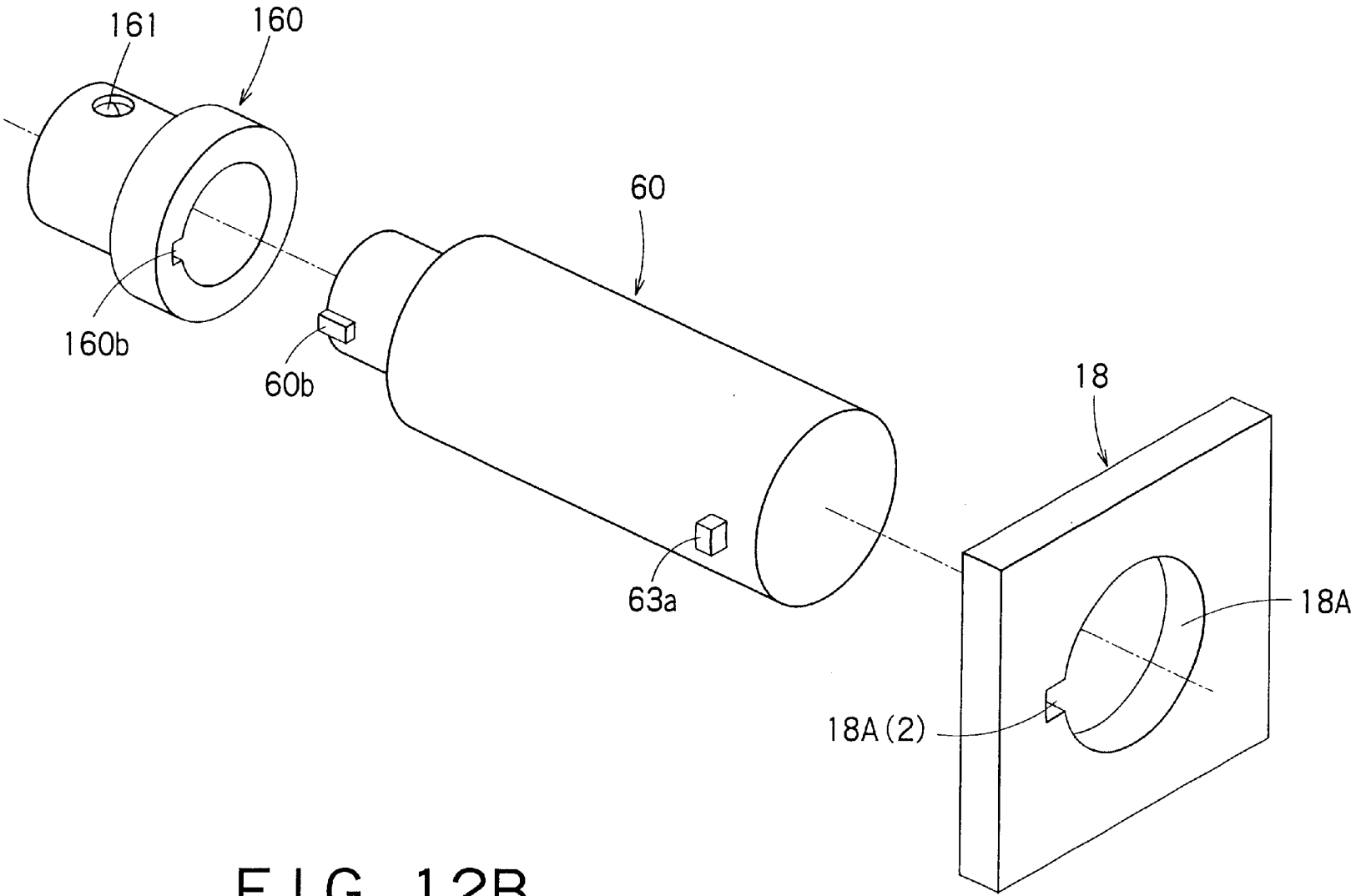

In the case of a product for the first region, the cap 160 is attached on or detached from the cylindrical container 60 by the engagement of a groove 160*a* formed in the cap 160 with a protrusion 60*a* formed on the container 60. In the mounting state, the cap 160 and cylindrical container 60 as a cartridge are inserted into or removed from the inlet guide 18. At this time, the positioning portion 63 and the expanded portion 18A(1) of the bole 18A of the inlet guide 18 are formed to face upwards in the figure. Thus, in the toner cartridge 16 passing through the inlet guide 18, the discharging hole 161 faces upwards to overlap with the supply hole 35*a* of the holder guide 35. On the other hand, in the case of another product for the second region, as shown in FIG. 12B, the groove of the cap 160 is provided at the position of 160*b* in place of the groove 160*a*. At this time, the positioning portion of the cylindrical container 60 is provided at the position of 63*a* in place of the positioning portion 63, and the expanded portion of the hole 18A of the inlet guide is provided at the position of 18A(2) in place of the expanded portion 18A(1). Thus, if the toner cartridge 16 is intended to pass through the inlet guide 18 for the first or second region, the discharging hole 161 faces upwards, so that the position of the holder guide 35 is coincident with the position of the supply hole 35*a*. However, for example, if the cartridge 16 for the first region is intended to be mounted on a copying machine for the second region, the cartridge 16 must be twisted when passing through the inlet guide 18. Although the cartridge 16 can pass through the inlet guide 18, the discharging hole 161 is shifted from the supply hole 35*a*, so that the toner can not be supplied. Thus, destination can be rightly carried out.

Furthermore, when the positioning portion 63 is provided on the cylindrical container 63 of the toner cartridge, it is required to cause the positioning portion 63 to protrude outwards from a cylindrical container having a conventional diameter, in order to ensure the quantity of the toner. In accordance therewith, for example, as can be seen from FIG. 10, a hole expanded portion (relief) 18A(1) for increasing the inner diameter is provided on the inlet guide 18 in order to position the protruding portion of the positioning portion 63.

What is claimed is:

1. A toner cartridge for use in a toner supply device for supplying a toner to an image forming system for forming an optional image including characters and pictures with said toner, said toner cartridge comprising:

a toner container having a cylindrical shape having an opening at a tip end thereof, said toner container being filled with a toner therein, said toner container having a spiral protruding portion formed in an inner peripheral surface thereof, and said toner container causing said toner, which is housed therein, toward said opening in an axial direction thereof when being rotated about an axis thereof;

a substantially cup-shaped cap engaging said opening and having a toner discharging hole for discharging said toner carried in said toner container, said cap being fixed to said toner container at a predetermined positional relationship when said cap is mounted on said toner container, so that said discharging hole always faces in a predetermined direction when said toner container is turned in a certain rotational direction with respect to said axis thereof; and a cylindrical cover engaging said cap so as to reciprocate in axial directions with respect to said cap between a first position on a tip end side and a second position on a base end side, said cylindrical cover closing said discharging hole to prevent said toner from being discharged at said first position, and opening said discharging hole to allow said toner to be discharged at said second position.

2. A toner cartridge as set forth in claim 1, wherein said cap having an engaging portion for receiving a force for rotating said toner cartridge about an axis thereof, from said image forming system when said toner cartridge is mounted on said image forming system.

3. A toner cartridge as set forth in claim 2, wherein said engaging portion comprises at least two protruding portions protruding from the top surface of said cap.

4. A toner cartridge as set forth in claim 3, wherein said discharging hole is formed in the outer peripheral surface of said cap at a position on a line which is drawn between said two protruding portions and which is substantially perpendicular to said axis.

5. A toner cartridge as set forth in claim 1, wherein said cap has protrusions on tip and base end sides along a bus line on an outer peripheral surface, and said cylindrical cover is movable in axial directions between said two protrusions to abut on said protrusions.

6. A toner cartridge as set forth in claim 5, wherein said two protrusions of said cap are formed at positions shifted from said discharging hole of said cap by substantially 90 degrees.

7. A toner cartridge as set forth in claim 5, wherein said cover has at least two substantially U-shaped cut-outs formed in a peripheral portion thereof to form tongue pieces serving as elastic cantilevers, each of said tongue pieces having external and internal stoppers formed on the outer surface and reverse surface thereof in the vicinity of an end thereof, said internal stopper being slidable between said two protrusions of said cap to abut on said protrusions.

8. A toner cartridge as set forth in claim 1, wherein a groove and a protrusion, which extend in axial directions and which engage with each other, are formed in an outer peripheral surface of said cap and an inner peripheral surface of said cylindrical cover, respectively, said cylindrical cover being attached to and detached from said cap by sliding said groove and said protrusion while said groove engages said protrusion, so that the relationship between the relative rotations of said cap and said cylindrical cover about an axes thereof is regulated to be a predetermined relationship.

9. A toner cartridge as set forth in claim 1, wherein a seal for decreasing a gap between said cover and said cap is provided between said cover and said cap, said seal having a cut-out which overlaps said discharging hole to inhibit leakage of said toner when said discharging hole is closed by said cover.

10. A toner cartridge as set forth in claim 1, wherein a protruding positioning portion is formed on the outer peripheral surface of said toner container at a predetermined position, said discharging hole being turned in a predetermined direction by turning said toner cartridge about the axis thereof on the basis of said positioning portion, said toner cartridge being attachable and detachable in this state.

11. A toner supply device for supplying a toner to an image forming system for forming an optional image including characters and pictures with said toner, said toner supply device comprising a toner cartridge and a drive unit for rotating said toner cartridge, said toner cartridge comprising:

a toner container having a cylindrical shape having an opening at a tip end thereof, said toner container being filled with a toner therein, said toner container having a spiral protruding portion formed in an inner peripheral surface thereof, and said toner container causing said toner, which is housed therein, toward said opening in an axial direction thereof when being rotated about an axis thereof;

a substantially cup-shaped cap engaging said opening and having a toner discharging hole for discharging said toner carried in said toner container, said cap being fixed to said toner container at a predetermined positional relationship when said cap is mounted on said toner container, so that said discharging hole always faces in a predetermined direction when said toner container is turned in a certain rotational direction with respect to said axis thereof; and a cylindrical cover engaging said cap so as to reciprocate in axial directions with respect to said cap between a first position on a tip end side and a second position on a base end side, said cylindrical cover closing said discharging hole to prevent said toner from being discharged at said first position, and opening said discharging hole to allow said toner to be discharged at said second position, said drive unit comprising a holder guide for receiving said toner cartridge, and a drive body for rotating said toner cartridge about the axis thereof in the inserted state, and said holder guide having cover forced closing means for contacting said cover to hove said cover in the axial direction thereof toward the base end side to open said discharging hole when said toner cartridge is inserted, and for contacting said cover to move said cover in the axial direction thereof toward the tip end to close said discharging hole when said toner cartridge is extracted.

12. A toner supply device as set forth in claim 11, wherein said cap of said toner cartridge and said drive body of said drive unit having engaging means, which engage with each other, for transmitting a driving force from said drive unit to said toner cartridge when said toner cartridge is mounted on said drive unit.

13. A toner supply device as set forth in claim 12, wherein said engaging means comprises at least two protruding portions protruding from the top surface of said cap, and at least two drive grooves for receiving said protruding portions formed in said drive body.

14. A toner supply device as set forth in claim 13, wherein said discharging hole is formed in the outer peripheral surface of said cap at a position on a line which is drawn between said two protruding portions and which is substantially perpendicular to said axis.

15. A toner supply device as set forth in claim 13, wherein said drive unit and said toner cartridge are formed as a pair according to destination, said drive body of said drive unit of said pair of said drive unit and said toner cartridge being stopped at a predetermined rotational position during said drive body is stopped, said two protruding portions of said toner cartridge being formed at positions, at which said two protruding-portions engage said drive grooves of said drive body when said discharging hole faces upwards, said engagement being not carried out in said cartridge for different destination.

16. A toner supply device as set forth in claim 11, wherein said cap has protrusions on tip and base end sides along a bus line on an outer peripheral surface, and said cover is associated with said forced closing means of said drive unit to be movable in axial directions between said two protrusions to abut on said protrusions.

17. A toner supply device as set forth in claim 16, wherein said two protrusions of said cap are formed at positions shifted from said discharging hole of said cap by substantially 90 degrees.

18. A toner supply device as set forth in claim 15, wherein said cover has at least two substantially U-shaped cut-outs formed in a peripheral portion thereof to form tongue pieces serving as elastic cantilevers, each of said tongue pieces having external and internal stoppers formed in the vicinity of a tip end thereof, said internal stopper being associated with said forced closing means of said drive unit to be slidable between said protrusions of said cap to abut on said protrusions.

19. A toner supply device as set forth in claim 16, wherein said forced closing means of said drive unit having at least two engaging protrusions protruding from the inner surface of said holder guide at substantially facing positions, said two engaging protrusions contacting an outer stopper of a tongue piece of said cover to stop the movement of said cover to move only said cap from said first position to said second position to open said discharging hole when said cap and cover of said toner cartridge are inserted into said holder guide, said outer stopper passing over said engaging protrusions to allow said cover and said cap to be integrally inserted into said holder guide after said cap is moved to said second position, said outer stopper engaging said engaging protrusions to stop the movement of said cover to move only said cap in an extracted direction from said second position to said first position to close said discharging hole when said toner cartridge is extracted, said outer stopper passing over said engaging protrusions in the extracted direction to allow said cover and said cap to be integrally extracted to the outside after said cap is moved to said first position.

20. A toner supply device as set forth in claim 11, wherein a groove and a protrusion, which extend in axial directions and which engage with each other, are formed in an outer peripheral surface of said cap and an inner peripheral surface of said cylindrical cover, respectively, said cylindrical cover being attached to and detached from said cap by sliding said groove and said protrusion while said groove engages said protrusion, so that the relationship between the relative rotations of said cap and said cylindrical cover about an axes thereof is regulated to be a predetermined relationship.

21. A toner supply device as set forth in claim 11, wherein a seal for decreasing a gap between said cover and said cap is provided between said cover and said cap, said seal having a cut-out which overlaps said discharging hole to inhibit leakage of said toner when said discharging hole is closed by said cover.

22. A toner supply device as set forth in claim 11, wherein a protruding positioning portion is formed on the outer peripheral surface of said toner container at a predetermined position, said discharging hole being turned in a predetermined direction by turning said toner cartridge about the axis thereof on the basis of said positioning portion, said toner cartridge being attachable on and detachable from said toner supply device in this state.

23. A toner supply device as set forth in claim 11, which further comprises an inlet guide having a guide hole for receiving said toner cartridge when said toner cartridge is attached on said drive unit, said inlet guide being associated with said toner cartridge for forming rotational position regulating means for allowing said toner cartridge to pass through said inlet guide when only said toner cartridge faces in a predetermined rotational direction.

24. A toner supply device as set forth in claim 23, wherein said rotational position regulating means comprises a positioning portion protruding from the outer peripheral surface of said toner container, and an expanded portion formed by expanding said guide hole of said inlet guide by cutting out a part of said guide hole.

25. A toner supply device as set forth in claim 24, wherein said toner container and said cap are attached and detached in a rotational positioned state.

26. A toner supply device as set forth in claim 25, wherein a groove and a protrusion, which extend in axial directions and which engage with each other, are formed in an outer peripheral surface of said toner container and an inner peripheral surface of said cap, respectively.

27. A toner supply device as set forth in claim 26, wherein when said toner container is attached on or detached from said toner supply device, if said toner supply device and said toner container have the same destination, when said toner cartridge is inserted into or removed from said inlet guide while being regulated by said rotational position regulating means in the state that said cap is mounted on said toner container, said discharging hole facing upwards, and protrusions of said cap being capable of being inserted into or removed from drive holes of said drive body.

* * * * *